US009506436B2

(12) United States Patent
Voutilainen

(10) Patent No.: US 9,506,436 B2
(45) Date of Patent: Nov. 29, 2016

(54) PIPE CONNECTOR AND FUEL INJECTION SYSTEM

(75) Inventor: Vesa Voutilainen, Vaasa (FI)

(73) Assignee: Wartsila Finland Oy, Vaasa (FI)

( * ) Notice: Subject to any disclaimer, the term of this patent is extended or adjusted under 35 U.S.C. 154(b) by 570 days.

(21) Appl. No.: 13/984,817

(22) PCT Filed: Jan. 24, 2012

(86) PCT No.: PCT/FI2012/050060

§ 371 (c)(1),
(2), (4) Date: Sep. 6, 2013

(87) PCT Pub. No.: WO2012/107634

PCT Pub. Date: Aug. 16, 2012

(65) Prior Publication Data

US 2014/0007844 A1 Jan. 9, 2014

(30) Foreign Application Priority Data

Feb. 9, 2011 (FI) ..... 20115124

(51) Int. Cl.
*F02M 57/02* (2006.01)
*F02M 55/00* (2006.01)
*F02M 55/02* (2006.01)

(52) U.S. Cl.
CPC ..... *F02M 55/004* (2013.01); *F02M 55/002* (2013.01); *F02M 55/005* (2013.01); *F02M 55/02* (2013.01); *F02M 2200/16* (2013.01); *F02M 2200/18* (2013.01); *F02M 2200/40* (2013.01)

(58) Field of Classification Search
CPC ... F02M 55/02; F02M 55/005; F02M 55/002
USPC ..... 123/446
See application file for complete search history.

(56) References Cited

U.S. PATENT DOCUMENTS 3,317,221 A 5/1967 Brown
4,440,135 A * 4/1984 Asami ..... F02M 61/205 123/446

(Continued)

FOREIGN PATENT DOCUMENTS

DE 199 31 282 C1 1/2001
DE 100 20 683 A1 10/2001

(Continued)

*Primary Examiner* — John Kwon
*Assistant Examiner* — James Kim
(74) *Attorney, Agent, or Firm* — Muncy, Geissler, Olds & Lowe, P.C.

(57) ABSTRACT

A pipe connector comprising a connector body, a first fitting connectable to a first double wall pipe, the first fitting comprising a first portion connectable to an inner flow space and a second portion connectable to an outer flow space of the first double wall pipe, a second fitting connectable to a second pipe, a third fitting comprising a first portion and a second portion, which first portion is connectable to the third pipe, and a flow channel arranged in the connector body for interconnecting the first portion of the first fitting, the second fitting and the first portion of the third fitting. The pipe connector comprises a leak channel arranged in flow connection with the second portion of the first fitting, a leakage outlet for discharging fluid from the leak channel, a discharge channel extending from the second portion of the third fitting to the leakage outlet and providing a continuous flow connection therebetween, and a closure member having a first position, in which fluid flow from the leak channel to the leakage outlet is prevented, and a second position, in which fluid flow from the leak channel to the leakage outlet is allowed. The closure member is arranged to move from the first position to the second position when fluid pressure in the leak channel rises above a certain limit.

10 Claims, 2 Drawing Sheets

(56) References Cited

U.S. PATENT DOCUMENTS

| | | | | |
|---|---|---|---|---|
| 4,445,713 | A | 5/1984 | Bruning | |
| 4,784,101 | A * | 11/1988 | Iwanaga | F02M 47/027 123/446 |
| 5,277,455 | A | 1/1994 | Graves et al. | |
| 5,365,907 | A * | 11/1994 | Dietrich et al. | F02F 1/242 123/468 |
| 6,725,840 | B1 * | 4/2004 | Mahr | F02M 45/00 123/467 |
| 8,332,130 | B2 * | 12/2012 | Stretch | F02D 33/003 123/479 |
| 8,844,842 | B2 * | 9/2014 | Kim | F02M 43/04 123/27 GE |
| 2007/0241560 | A1 * | 10/2007 | Malone | F16L 9/19 285/319 |
| 2011/0108004 | A1 * | 5/2011 | Wickstone | F02D 19/08 123/468 |
| 2011/0214643 | A1 * | 9/2011 | Blizard | F02M 53/02 123/468 |

FOREIGN PATENT DOCUMENTS

| | | | |
|---|---|---|---|
| EP | 1469188 | A1 | 10/2004 |
| EP | 2011996 | A1 | 1/2009 |
| GB | 2 013 822 | A | 8/1979 |
| GB | 2060800 | A | 5/1981 |
| JP | 59 146567 | U | 9/1984 |
| JP | 62 038476 | U | 3/1987 |
| WO | WO 2007/057629 | A1 | 5/2007 |
| WO | WO 2008/019415 | A1 | 2/2008 |
| WO | WO 2009/147291 | A2 | 12/2009 |

* cited by examiner

PIPE CONNECTOR AND FUEL INJECTION SYSTEM

The invention relates to a pipe connector for interconnecting a first double wall pipe, a second pipe and a third pipe. The invention also relates to a fuel injection system.

It is commonly known to arrange fuel pipes of a diesel engine inside another pipe in order to keep possible leakage inside the outer pipe. In case of leak, the leaking fuel may be carried along inside the outer pipe away from the vicinity of the engine. In order to detecting the leak in this kinds of a solution e.g. different kinds of plugs has been used. Thus the leak may have been detected by unplugging the plug. Another used manner has been to utilise disengageable hoses, and by disconnecting such, leak may also have been detected. This known method is, however, very unsophisticated, because the locating of leak by this method is very slow and also troublesome.

An object of the present invention is to provide a new pipe connector for connecting double wall pipes. A further object of the invention is to provide a fuel injection system with an improved fuel leak detection system.

The objects are achieved as disclosed in claims 1 and 6.

A pipe connector according to the invention comprises a connector body, a first fitting connectable to a first double wall pipe, the first fitting comprising a first portion connectable to the inner flow space and a second portion connectable to the outer flow space of the first double wall pipe, a second fitting connectable to a second pipe, a third fitting comprising a first portion and a second portion, which first portion is connectable to the third pipe, and a flow channel arranged in the connector body for interconnecting the first portion of the first fitting, the second fitting and the first portion of the third fitting. The pipe connector comprises a leak channel arranged in flow connection with the second portion of the first fitting, a leakage outlet for discharging fluid from the leak channel, a discharge channel extending from the second portion of the third fitting to the leakage outlet and providing a continuous flow connection therebetween, and a closure member having a first position, in which fluid flow from the leak channel to the leakage outlet is prevented, and a second position, in which fluid flow from the leak channel to the leakage outlet is allowed. The closure member is arranged to move from the first position to the second position when fluid pressure in the leak channel rises above a certain limit.

In the following the invention will be described by way of an example with reference to the accompanying drawings, in which.

Figure 1:
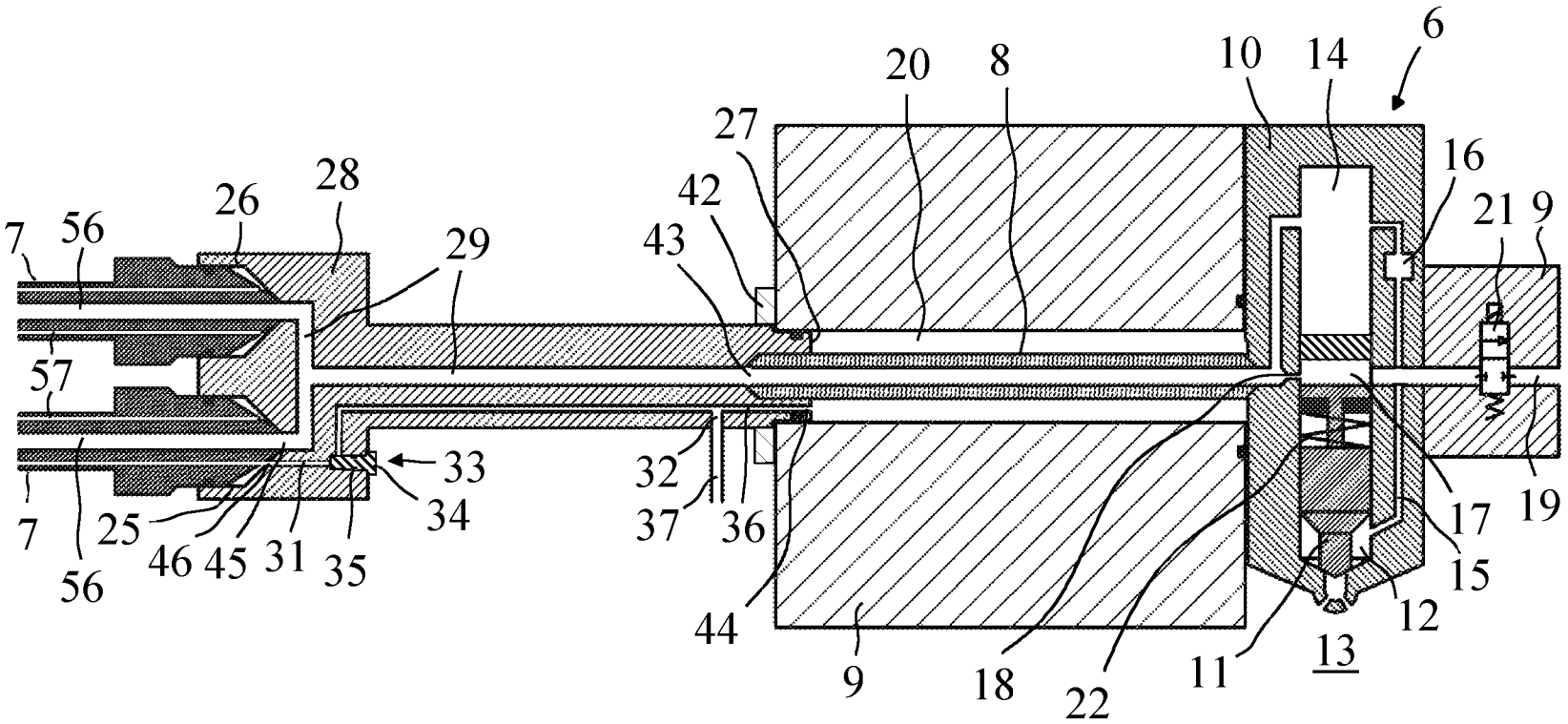
FIG. 1 is a cross sectional view of a pipe connector according to an embodiment of the present invention.

FIG. 1 shows a pipe connector 24 for fluidly interconnecting a first double wall pipe, a second double wall pipe and a third pipe. The double wall pipe comprises an inner flow space for fluid, such as fuel, and an outer flow space for fluid leaking from the inner flow space. The pipe connector 24 is arranged to interconnect an inner flow space of the first double wall pipe, an inner flow space of the second double wall pipe and the third pipe. The pipe connector 24 can be a T connector.

The pipe connector 24 comprises three fittings 25, 26, 27. A first fitting 25 is connectable to the first double wall pipe. The first fitting comprises a first portion 45 connectable to the inner flow space 56 and a second portion 46 connectable to the outer flow space 57 of the first double wall pipe. A second fitting 26 is connectable to the inner flow space of the second double wall pipe. A third fitting 27 comprises a first portion 43 and a second portion 44. The first portion 43 is connectable to the third pipe. The third pipe can be a double wall pipe, which comprises an inner flow space for fluid and an outer flow space for possibly leaking fluid. In that case, the first portion 43 of the third fitting is connectable to the inner flow space and the second portion 44 of the third fitting is connectable to the outer flow space of the third pipe.

The pipe connector 24 comprises a connector body 28, in which a flow channel 29 is arranged for fluidly interconnecting the first portion 45 of the first fitting, the second fitting 26 and the first portion 43 of the third fitting. A leak channel 31 is arranged in the connector body 28 in flow connection with the second portion 46 of the first fitting. The pipe connector 24 comprises a leakage outlet 32 for discharging fluid from the leak channel 31. The pipe connector 24 comprises a discharge channel 36, which extends from the second portion 44 of the third fitting to the leakage outlet 32 and provides a continuous flow connection therebetween. The discharge channel 36 is arranged in the connector body 28. The pipe connector 24 does not comprise a channel or other means for fluidly connecting the outer flow space of the second double wall pipe to the leak channel 31.

The pipe connector 24 is provided with a leak detector 33 for detecting fluid, such as fuel, flowing into the leak channel 31. The leak detector 33 comprises a closure member, such as a pin 34, which extends into the leak channel 31. The pin 34 has a first position, in which fluid flow from the leak channel 31 to the leakage outlet 32 is prevented, and a second position, in which fluid flow from the leak channel 31 to the leakage outlet 32 is allowed. The closure member 34 is arranged to move from the first position to the second position when fluid pressure in the leak channel 31 rises above a certain limit. In the first position the pin 34 blocks the leak channel 31 and thus prevents fuel flow from the leak channel 31 to the leakage outlet 32. In the second position the pin 34 uncovers the leak channel 31 so that a flow connection exists between the leak channel 31 and the leakage outlet 32.

The pin 34 is provided with a holding member for keeping the pin 34 in the first position when the pressure in the leak channel 31 is low. The holding member comprises rings 35 made of rubber or other suitable material and arranged around the outer surface of the pin 34. The rings 35 are against the inner surface of the leak channel 31. The pressure, at which the pin 34 begins to move from the first position towards the second position, can be set by proper design of the rings 35. In the second position the pin 34 protrudes from the connector body 28. Thus, the second position of the pin 34 can be detected from outside the connector 24. Since the leak channel 31 is in flow connection with only one fitting, the protruding pin 34 shows the double wall supply pipe, in which the leak occurs.

Figure 2:
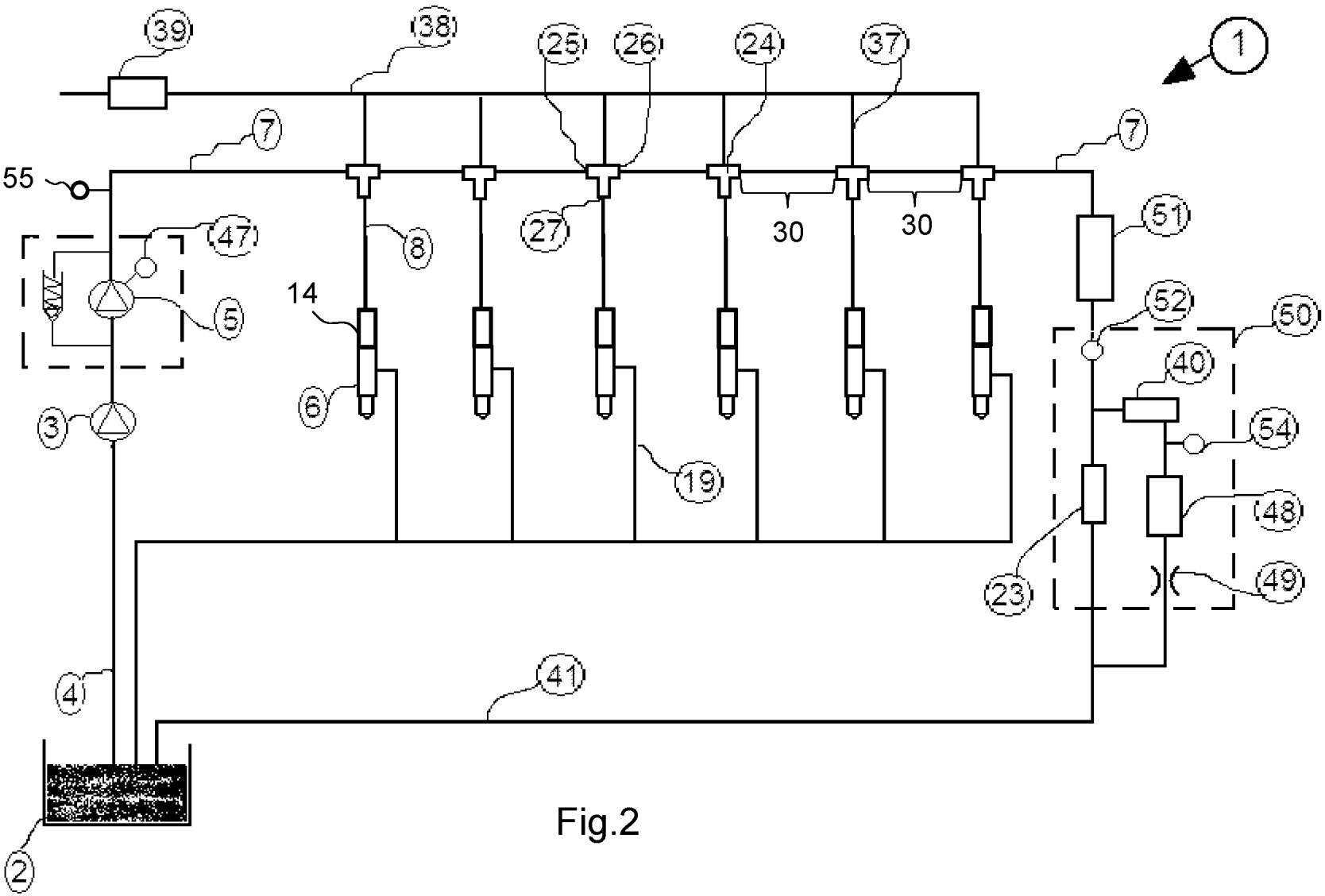
FIG. 2 shows schematically a fuel injection system according to an embodiment of the present invention.

FIG. 2 shows schematically a fuel injection system 1 of a large reciprocating engine, for example of a large diesel engine. Cylinders of the engine can be arranged inline or in V configuration. Large reciprocating engine refers here to such engines that can be used for instance as main and auxiliary engines in ships or in power plants for production of heat and/or electricity. The engine can be operated by heavy fuel oil. The fuel injection system 1 comprises fuel injectors 6 for injecting fuel into the cylinders of the engine. Additionally, the fuel injection system comprises a fuel source, for example a fuel tank 2, from which fuel is fed by means of a low pressure 3 pump along a fuel line 4 into a high pressure pump 5. The high pressure pump 5 elevates the fuel pressure to a level that a sufficient injection pressure may be obtained in the injectors 6. If the cylinders are arranged in V configuration, the fuel injection system 1 can comprise a common high pressure pump for both cylinder banks or each cylinder bank can be provided with a separate high pressure pump. The high pressure pump 5 is provided with a temperature sensor 47 for measuring fuel temperature.

The fuel injection system 1 comprises 1 a double wall supply pipe 7 for feeding fuel from the high pressure pump 5 toward the fuel injectors 6. One end of the double wall supply pipe 7 is connected to the high pressure pump 5. The double wall supply pipe 7 comprises an inner flow space 56 for feeding fuel toward the injectors 6 and an outer flow space 57 for possibly leaking fuel. Fuel is fed from the high pressure pump 5 toward the injectors 6 through the inner flow space. The outer flow space acts as a collecting channel for possibly leaking fuel. Each injector 6 is connected to the double wall supply pipe 7 by means of a separate feed pipe 8. First end of the feed pipe 8 is connected to the injector 6. Second end of the feed pipe 8 is connected to the double wall supply pipe 7 by means of the pipe connector 24 shown in FIG. 1. The supply pipe 7 can be provided with a pressure sensor 55, which is arranged to measure the fuel pressure in the inner flow space 56. The pressure sensor 55 can be installed between the high pressure pump 5 and the first pipe connector 24 in the fuel flow direction.

The first fitting 25 and the second fitting 26 of the pipe connector 24 are connected to the double wall supply pipe 7. The first portion 45 of the first fitting and the second fitting 26 are connected to the inner flow space 56 of the double wall supply pipe 7. The second portion 46 of the first fitting is connected to the outer flow space 57 of the double wall supply pipe 7. The first portion 43 of the third fitting is connected to the feed pipe 8. The outer flow space of the double wall supply pipe 7 connected to the second fitting 26 is fluidly separated from the leak channel 31 and the outer flow space of the supply pipe 7 connected to the first fitting 26. Thus, the pipe connectors 24 divide the outer flow space of the double wall supply pipe 7 into compartments 30, which are fluidly separated from each other.

The double wall supply pipe 7 is provided with a circulation valve 23 for connecting the supply pipe 7 to the fuel tank 2. The circulation valve 23 enables the circulation of fuel in the injection system 1, for example for heating it before starting of the engine. Further, the double wall supply pipe 7 is provided with a safety valve 40, which protects the fuel injection system 1 against excess pressure. The safety valve 40 maintains the pressure in the supply pipe 7 below a predetermined maximum value. The safety valve 40 can also act as a pressure drop valve, by which the fuel injection system 1 can be depressurized. The outlet side of the safety valve 40 is provided with a discharge container 48 and a throttle 49, through which fuel discharged from the safety valve 40 flows. The throttle 49 is placed downstream of the container 48. The discharge container 48 and the throttle 49 dampen the pressure pulsation of fuel. Further, the outlet side of the safety valve 40 is provided with a fuel temperature sensor 54 for measuring the fuel temperature so as to reveal possible fuel leaks from the safety valve 40. The circulation valve 23 and the safety valve 40 are connected to the fuel tank 2 through a return line 41. The circulation valve 23 and the safety valve 40 can be integrated into a single valve module 50. Additionally, the valve module 50 comprises the discharge container 48 and the throttle 49. The valve module 50 can also comprise the fuel temperature sensor 54. The circulation valve 23 and the safety valve 40 are connected to the double wall supply pipe 7 at a location downstream of the last pipe connector. A high pressure volume 51 can be connected to inner flow space of the double wall supply pipe 7. The purpose of the high pressure volume 51 is to dampen fuel pressure pulsations in the inner flow space. The high pressure volume 51 can be connected to the double wall supply pipe at a location downstream of the last pipe connector 24. The valve module 50 can be provided with a pressure sensor 52, which is arranged to measure fuel pressure in the inner flow space of the double wall supply pipe 7. The pressure measurements of pressure sensor 55 and the fuel pressure sensor 52 are used in the control of the fuel pressure in the inner flow space. The fuel pressure in the inner flow space can be controlled on the basis of the higher pressure measured by the sensors 52, 55.

The fuel injection system 1 is provided without a pressure accumulator (common rail), to which one or more feed pipes 8 are connected. A conventional common rail fuel injection system comprises a pressure accumulator into which fuel is fed from the high pressure pump and from which fuel is further fed into one or more injectors by feed pipes. The injection system shown in FIG. 1 does not comprise such a pressure accumulator i.e. a pressure accumulator to which one or more feed pipes 8 are connected. It is commonly known in the field of fuel injection that the pressure accumulator has to store a considerable volume of pressurized fuel i.e. fuel is accumulated in the pressure accumulator. Depending on the shape of the pressure accumulator, the cross sectional flow area of the pressure accumulator is typically considerably greater than that of fuel discharge pipes connected thereto. In the embodiment shown in the drawings, the cross sectional flow area of the supply pipe 7 (inner flow space) is as great as or slightly greater than the cross sectional flow area of the feed pipes 8 connected thereto.

The basic construction of the fuel injector 6 is shown in more detail in FIG. 1. The fuel injectors 6 are mounted on the cylinder head 9 of the engine. The cylinder head 9 comprises a bore 20 in which the feed pipe 8 is arranged. The fuel injector 6 comprises an injector body 10, in which a fuel chamber 12 and a valve needle 11 are arranged. The valve needle 11 controls fuel injection from a fuel chamber 12 into the engine cylinder 13. Depending on the position of the valve needle 11, the fuel injection from the fuel chamber 12 into the cylinder 13 is either allowed or prevented. The injector 6 comprises a pressure accumulator 14 for fuel. The pressure accumulator 14 is an integral part of the injector 6. The pressure accumulator 14 can be arranged in the injector body 10. The volume of the pressure accumulator 14 is at least 40, typically 50 to 70 times the amount (volume) of fuel injected by the injector 6 during one injection event at full (100%) engine load.

The pressure accumulator 14 is in flow connection with the fuel chamber 12 via a connecting channel 15. A flow fuse 16 is arranged in the connecting channel 15. The flow fuse 16 prevents the fuel flow from the injector pressure accumulator 14 to the fuel chamber 12 in case of malfunction of the injector 6, for example when the valve needle 11 fails to close properly.

The injector 6 comprises a control chamber 17 into which fuel is fed through the feed pipe 8. An inlet of the control chamber 17 is provided with a throttle 18 by which the fuel flow into the control chamber 17 can be restricted. The fuel pressure in the control chamber 17 acts on the valve needle 11. The force caused by the fuel pressure in the control chamber 17 urges the valve needle 11 toward the closed position. The movement of the valve needle 11 and thus the fuel injection into the cylinder 13 can be controlled by adjusting fuel pressure in the control chamber 17. A return line 19 for discharging fuel from the control chamber 17 is connected to the injector 6. The return line 19 is arranged in or connected to a second bore 53 in the cylinder head 9. A control valve 21 is arranged in the return pipe 19 for controlling the discharge of fuel from the control chamber 17. The control valve 21 can be a solenoid valve. The injector 6 is also provided with a spring 22 which urges the valve needle 11 toward the closed position.

To initiate the fuel injection the control valve 21 is opened. Fuel flows from the control chamber 17 into return line 19 and the fuel pressure in the control chamber 17 decreases. Fuel flows through the second bore 53 and the return line 21 into the fuel tank 2. When the pressure in the control chamber 17 is low enough, the force caused by the fuel pressure in the fuel chamber 17 urges the valve needle 11 toward the open position against the force of spring 22. As a result, the valve needle 11 is lifted from its seat and fuel is injected from the fuel chamber 12 into the cylinder 13. When the control valve 21 is closed, fuel pressure in the control chamber 17 increases. Consequently, the valve needle 11 returns to its closed position against the seat so that fuel injection from the fuel chamber 12 into cylinder 13 stops.

The feed pipe 8 is arranged in the bore 20 in the cylinder head 9. The pipe connector 24 is connected to the cylinder head 9 so that the bore 20 opening surrounds the third fitting 27 and the discharge channel opening. The pipe connector 24 comprises a mounting bracket 42, by which it can be attached to the cylinder head 9. A clearance between the outer surface of the feed pipe 8 and the inner surface of the bore 20 acts as a drain channel for fuel leaking from the injector 6. The bore 20 is in flow connection with the leakage outlet 32 through the discharge channel 36. Thus, fuel leaking from the injector 6 can be drained through the leakage outlet 32.

FIG. 1 shows a normal situation in which there is no leak and the pin 34 is in the first position in the connector body 28. If leaking fuel flows to the leak channel 31, the pressure in the leak channel begins to rise. As the pressure in the leak channel 31 rises above a certain level, the pin 34 begins to move outwards from the connector body 28, until the second position is reached. In the second position fuel flows from the leak channel 31 to the leakage outlet 32. Since the leak channel 31 is in flow connection with only one compartment 30, the protruding pin 31 also indicates the supply pipe section in which the leak occurs.

A discharge line 37 is connected to the leakage outlet 32. The discharge lines 37 from the pipe connectors 24 are connected to a common collecting line 38. Flow of leaking fuel from the discharge lines 37 is led to the collecting line 38. The collecting line 38 is provided with a leak detection device 39. The leak detection device 39 is connected to the collecting line 38 to a location through which all fuel from the discharge lines 37 flows. Because in normal operating conditions of the injectors 6 a small amount of fuel leaks from the injectors 6, it is favorable that only larger flows of leaking fuel are detected. Therefore, the leak detection device 39 is arranged to detect only fuel flows having a flow rate over a predetermined value. When the predetermined flow rate is exceeded, the leak detection device 39 is arranged to trigger an alarm or otherwise indicate that there is a fuel leak from the injector 6 or the double wall supply pipe 7. If the leak detection device indicates a leak and all the pins 34 are in the position, fuel leaks from the injector 6 and/or feed pipe 8. Correspondingly, if at least one of the pins 34 is in the second position, fuel leaks from the double wall supply pipe 7. The pin 34 also indicates the supply pipe section, in which the leak occurs.

The invention claimed is:

1. A pipe connector for interconnecting an inner flow space of a first double wall pipe, a second pipe and a third pipe, which pipe connector comprises:

a connector body;

a first fitting connectable to the first double wall pipe, the first fitting comprising a first portion connectable to the inner flow space and a second portion connectable to an outer flow space of the first double wall pipe;

a second fitting connectable to the second pipe;

a third fitting comprising a first portion and a second portion, which first portion is connectable to the third pipe; and a flow channel arranged in the connector body for interconnecting the first portion of the first fitting, the second fitting and the first portion of the third fitting, wherein the pipe connector comprises:

a leak channel arranged in flow connection with the second portion of the first fitting a leakage outlet for discharging fluid from the leak channel;

a discharge channel extending from the second portion of the third fitting to the leakage outlet and providing a continuous flow connection therebetween; and a closure member having a first position, in which fluid flow from the leak channel to the leakage outlet is prevented, and a second position, in which fluid flow from the leak channel to the leakage outlet is allowed, wherein the closure member is arranged to move from the first position to the second position when fluid pressure in the leak channel rises above a certain limit.

2. The pipe connector according to claim 1, wherein the position of the closure member can be detected from outside the pipe connector.

3. The pipe connector according to claim 1, wherein the closure member is arranged to protrude from the connector body in the second position.

4. The pipe connector according to claim 1, wherein the second pipe is a double wall pipe, and that the second fitting is connectable to the inner flow space of the second pipe.

5. The pipe connector according to claim 4, wherein the pipe connector does not comprise means for fluidly connecting the outer flow space of the second double wall pipe to the leak channel.

6. A fuel injection system for a reciprocating engine, comprising:

injectors for injecting pressurized fuel into the cylinders of the engine;

a high pressure pump for pressurizing fuel to be injected;

a double wall supply pipe comprising an inner flow space for feeding fuel from the high pressure pump toward the injectors and an outer flow space for possibly leaking fuel;

feed pipes for feeding fuel from the double wall supply pipe to the injectors, wherein the double wall supply pipe is connected to the feed pipes by means of pipe connectors according to claim 1, and that the first fittings and the second fittings of the pipe connectors are connected to the double wall supply pipe and the third fittings to the feed pipes.

7. The fuel injection system according to claim 6, wherein discharge lines are connected to the leakage outlets, and a collecting line is arranged in flow connection with the discharge lines.

8. The fuel injection system according to claim 7, wherein the collecting line is provided with a leak detection device.

9. The fuel injection system according to claim 6, wherein the fuel injector comprises a control chamber for fuel, and that fuel injection from the injector is controlled by adjusting fuel pressure in the control chamber.

10. The fuel injection system according to claim 6, wherein a return line for discharging fuel from a control chamber is connected to the injector.

* * * * *